US005168255A

United States Patent [19]

Poulsen

[11] Patent Number: 5,168,255

[45] Date of Patent: Dec. 1, 1992

[54] THREE PHASE TRANSFORMER

[76] Inventor: Peder U. Poulsen, Huntington Rd. Box 197, Stratford, Conn. 06497

[21] Appl. No.: 856,386

[22] Filed: Mar. 24, 1992

[51] Int. Cl.[5] ..... H01F 33/00; H01F 27/30

[52] U.S. Cl. ..... 336/5; 336/183; 336/205; 336/213; 336/223

[58] Field of Search ..... 336/5, 10, 12, 60, 96, 336/183, 213, 223, 228, 214, 215, 205

[56] References Cited

U.S. PATENT DOCUMENTS 2,359,173 9/1944 Troy ..... 336/213
3,617,965 11/1971 Trench ..... 336/213
4,588,971 5/1986 Beisser ..... 336/5

*Primary Examiner*—Thomas J. Kozma
*Attorney, Agent, or Firm*—John H. Crozier

[57] ABSTRACT

Three phase transformer, e.g. distribution transformer, comprising three frame shaped winding assemblies, each containing primary and secondary windings, two of said assemblies being substantially identical and juxtaposed to form a center leg having substantially circular cross section, and a third winding assembly surrounding the two said assemblies, and forming, together with the outside half legs of said winding assemblies, two outside legs, each having substantially circular cross section, the three winding assemblies being interlinked by hollow, cylindrical cores wound from ferromagnetic strip material and surrounding each of the three legs.

6 Claims, 1 Drawing Sheet

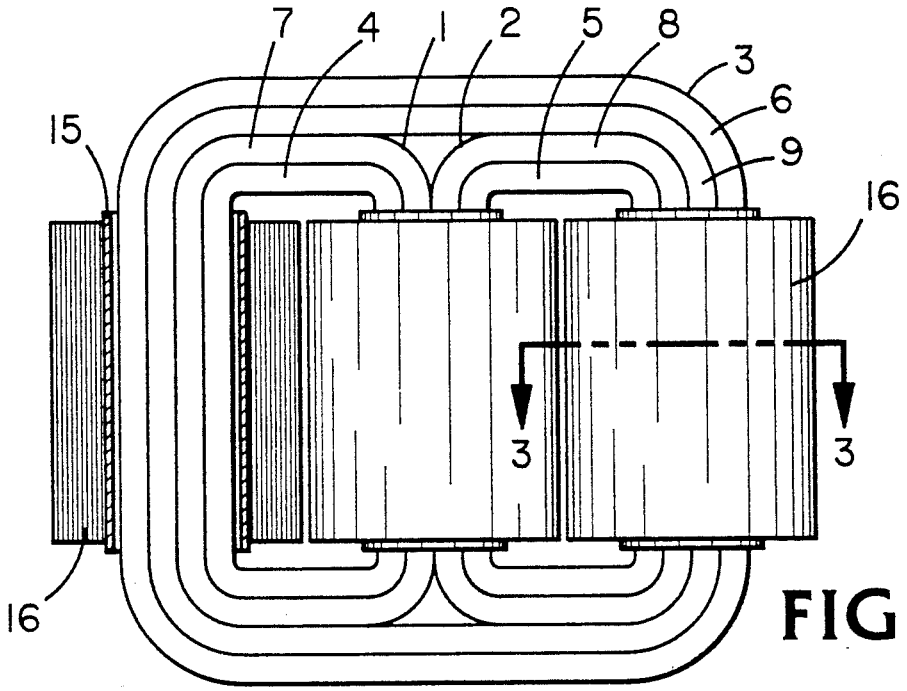
FIG. 1
FIG. 2
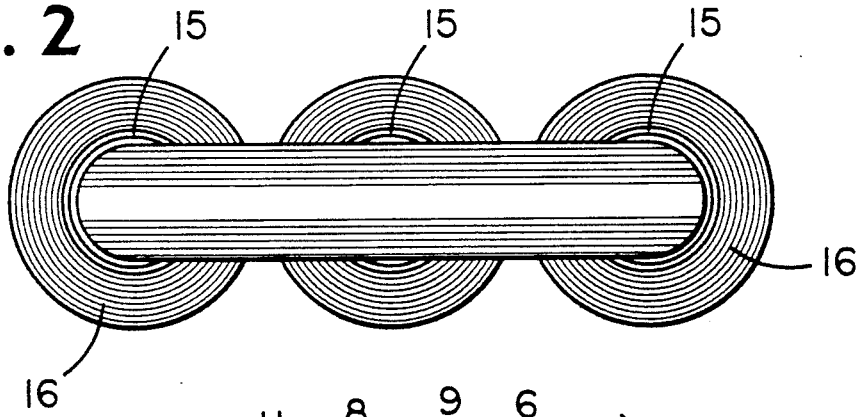
FIG. 3
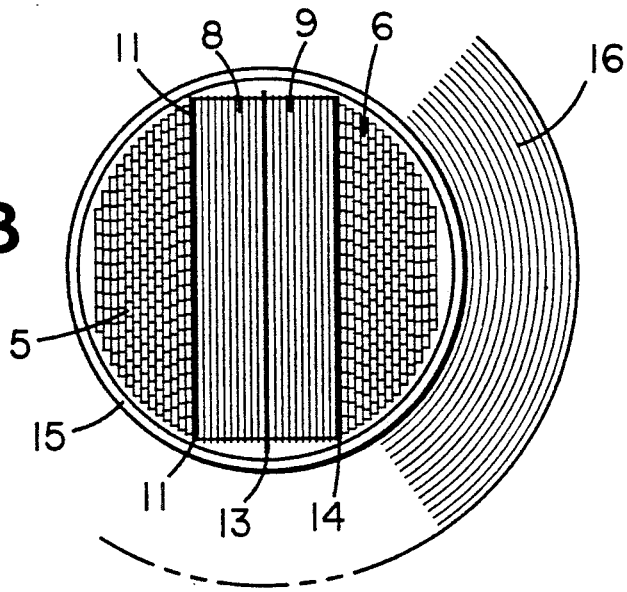

THREE PHASE TRANSFORMER

The present invention relates to three phase electric transformers in general and more specifically to three phase distribution transformers which are used for stepping down voltage at user locations along a power line.

Transformers generally contain two or more electrical circuits, primary and secondary windings, consisting of multi-turn coils of electrical conductors which are interlinked by means of one or more magnetic circuits or cores.

Traditionally cores consist of a plurality of ferromagnetic laminations which are stacked together to form a closed loop, surrounding and coupling magnetically the primary and secondary windings. Cores may be manufactured either from mutually overlapping or abutting individual laminations or from continuous strip of magnetic sheet material which is wound around a mandrel to form a closed circuit. The magnetic and electric circuits are combined either by assembling the cores around pre-wound primary and secondary coils, or by winding the conductor coils around one or more legs of the closed magnetic circuit. Another way of interlinking the circuits is to wind a continuous strip of magnetic material through the pre-wound electric coils to form one or more magnetic core sections which surround parts of the primary and secondary windings.

Prior art describes numerous variations of the basic principle outlined in the above, all aiming towards producing and combining the circuits with a minimum of labor, and at the same time optimizing the usage of conductor and core material in order to improve material economy and mininmize electric losses in core and coils. One way of shortening either the electric or magnetic paths is to use circular coils surrounding substantially circularly sectioned core legs, or a cylindrically shaped wound core which surrounds primary and secondary windings with a combined, substantially circular, cross section.

Single phase transformers employing the latter principle are described in U.S. Pat. Nos. 2,160,589 2,314,912 and 4,906,960 which all relate to transformers wherein cores or core sections are formed by winding continuous magnetic strip around the legs of pre-wound assemblies of primary and secondary coils.

U.S. Pat. No. 2,431,128, Link, relates to a three phase transformer comprising a core structure which contains two identical frame shaped sections, each wound from one or more continuous strips of ferro magnetic material, the two sections being juxtaposed, and forming, together with a surrounding third frame section, a structure with a center leg and two outside legs which are all mutually coupled and of identical cross section. The shape of the cross section can be either rectangular or brought to approximate a circle by employing a plurality of strip widths in each part section to produce so called cruciform core legs.

Further modifications of the construction described above are contained in German Pat. No. 1,011,056 and French Pat. No. 1,107,583 as well as U.S. Pat. Nos. 2,946,028 and 4,557,039 which all describe cores having cross sections shaped like regular hexagons or polygons of higher order. These shapes represent improved approximations to a circular cross section and contain triangular or trapezoidal part sections which have been wound from strip having continuously increasing or decreasing width.

It is a common drawback of the cruciform and polygonal cores described in the above that they are quite labor demanding to produce. In addition, in order to install the coils, cores must be cut and reassembled, or the coils must be wound around the core legs into the closed structure by rotating split bobbins around the legs. This winding process is impeded by protuding terminals and taps and is difficult and time consuming and not easily mechanized. Furthermore the core designs mentioned are poorly suited for amorpheous core material which is difficult to slit and would require extensive clamping and supporting means in order to retain its shape during fabrication and later on in the completed transformer. Finally, the flux density is rarely uniform in this type core because some of the flux must travel from the center leg to the outer core loop perpendicularly to the laminations. This means locally higher core losses and overall reduced efficiency.

The three phase transformer of the invention aims towards eliminating the above mentioned drawbacks within a similar geometrical framework. According to the invention this is achieved by interchanging the core material and the conductor material, resulting in a structure which is less labor demanding to produce and much better suited for amorpheous core material. An interchange of the same nature but dealing with a single phase transformer has been proposed in U.S. Pat. No. 4,906,960, referred to in the above, wherein cylindrical cores surround one, two or more legs in a single loop of primary and secondary windings.

Contrary to the three phase designs cited above, the construction of the invention does not require slitting of multiple widths or taper slitting of core material, and the coil assemblies may be pre-wound and combined with the core sections in a simple, easily mechanized procedure. A transformer according to the invention is ideally suited for amorpheous core material because each core section is wound from a constant width strip, preferably in width as cast, and is shaped like a hollow cylinder which may be supported vertically resting on one end, eliminating the need for extensive clamping and supporting structure. If required, in a larger unit two or more core sections may surround each leg placed end to end.

A preferred embodiment of the invention will be described in the following with reference to the drawings, in which

THE DRAWINGS

FIG. 1 is a side view of a three phase transformer according to the invention, partly sectioned, showing the coil assemblies and core sections but not showing terminals and supporting and enclosing structure etc.;

FIG. 2 is the same viewed from above, and;

FIG. 3 is a cross section along a plane A—A in FIG. 1 illustrating the construction of the primary and secondary coils of winding assemblies 2 and 3.

The transformer illustrated in the figures can be used as either a step down transformer, as in the case of a distribution transformer, or a step up transformer, and contains three window shaped winding assemblies, 1, 2 and 3, insulated from one another, each assembly in turn containing high voltage windings, 4, 5 and 6, and low voltage windings, 7, 8 and 9. In the illustrated embodiment the low voltage windings are produced from strip of e.g. copper or aluminum, almost as wide as the assembly and wound interleaved with an insulating material, one turn upon the other, forming together an elongated, rectangular cross section located adjacent to the center plane of each leg. The high voltage windings are produced from a narrower strip of a conductor material surrounded by insulation, which is wound in layers, several turns to the layer, the layers being of increasing or diminishing width to form together part sections which combine with the low voltage windings into half legs having substantially semi-circular cross section.

The winding assemblies according to the invention, may be produced by rotating a rectangular coil form in a winding machine which is provided with a wire guide capable of laying the conductor down with a carefully controlled pitch, and reversing the direction of cross-feed in the correct location after completing each layer, according to a predetermined pattern, to produce a winding with a cross section which conforms substantially with a circle segment.

The two smaller winding assemblies 1 and 2 are produced with the high voltage section 4 and 5 first, starting with a few turns per layer and gradually increasing the width of the layers in accordance with the desired sectional shape until reaching the desired total number of turns. Next a layer 11 of insulating material is laid down, consisting of e.g. several turns of electrical paper or insulating film somewhat wider than the widest, finishing layer of the high voltage coil.

The next stage is producing the low voltage winding 7 and 8 from full width strip or foil which is either preinsulated or laid down interleaved with an insulating layer. The winding takes place without cross feed to produce a rectangular part section largely filling the remaining part of the total semi-circular cross section of the assembly. Winding assemblies 1 and 2 are completed by applying an insulating layer 13 on top of the low voltage windings as interphase insulation.

The third winding assembly 3 which will surround assemblies 1 and 2 may be wound separately, to be combined with the others at a later stage, or it may be wound directly on top of assemblies 1 and 2 which are first juxtaposed and placed in the winding machine together. In any case, this time the low voltage winding 9 is laid down first, in similar fashion as before, whereafter an insulating barrier layer 14 is applied, and the high voltage winding 6 produced from the narrow conductor while utilizing the cross feed to complete the semi-circular contour.

After completing the winding process, the edges of the insulating layers 11, 13 and 14 are folded down and the legs and coil heads are bandaged to produce a three leg coil assembly with sufficient structural integrity. During the winding the necessary terminals have been attached in the proper locations, and spacers and additional insulation installed as required. These elements are not shown in the drawings. Dependent on the application the mechanical strength and dielectric properties of the assembly may be improved by means of impregnating with varnish or encapsulating the coil assembly in a suitable casting resin.

It is a matter of course that many modifications are possible in the production of the coil assembly within the scope of the invention, one being the winding of the sub assemblies on circular mandrels and forming them into window sections and combining them at a later stage. Another would be winding the low voltage winding from heavier strip wound several turns to a layer, or form winding the primary or secondary or both with magnet wire while using interlayer insulation or heat bonding to fixate the semi-circular cross section.

The magnetic circuits in a three phase transformer according to the invention consist of hollow cylinders 16 of core material surrounding each of the three legs of the completed coil assembly. For maximum performance the core sections are pre-wound on a mandrel and stress relief annealed in order to restore or sometimes enhance the original properties of the core material. After the annealing process the core cylinders are transferred to the legs and this procedure may be facilitated by first applying a split sleeve 15 of e.g. fiberglass sheet to each leg and providing means to rotate it around the leg.

The pre-wound and annealed cores are placed on a decoiler consisting of an expandable, rotatable mandrel or vertically on a turntable, and the strip end from either the outside or the inside of the core attached to the sleeve. At this point the sleeve 15 is brought to rotate and the core gradually transferred to the leg. During the process it is important not to re-introduce mechanical stresses in the core material, and it is preferable to unwind the pre-wound core from the inside in order to reproduce exactly the original curvature of the magnetic strip in all parts of the core.

Regardless of whether the re-winding is done from the inside or the outside of the pre-wound cores, it is a process which is relatively easily mechanized and may be carried out on all three legs simultaneously in order to save time.

I will be obvious that in a transformer according to the invention the magnetic flux is not required to cross over perpendicularly to the laminations as in the three phase transformers cited under prior art. For this reason the flux density is largely uniform and full advantage can be taken of the low loss characteristics of amorpheous core materials.

On the other hand, and rendering the core/conductor interchange less obvious, the electric path in winding assembly 3 is much longer that of assemblies 1 and 2, and thus the load losses in that branch much higher, the exact amount being dependent on the geometry.

Now, though this electrical unbalance may seem serious at first glance, in practice it does hardly present a problem for the following reasons: First, due to the relatively tight design effected by the circularly cross sectioned windings and cylindrical cores, the total electrical path is not longer and thus the resistive losses not higher than in traditional designs. Besides, most three phase transformers see grossly unbalanced load in everyday service, compared to which the unbalanced electrical losses caused by the unequal length of the coil assemblies is relatively unimportant.

In addition, in recent years when judging distribution transformers, core losses, which are present continuously regardless of load, are given much more weight than the coil losses which increase relative to the load squared, and thus affect the economy mostly when the transformer is operating at or near full load.

Performancewise there might be the consideration that the relatively higher losses in assembly 3 might cause hot spots in the transformer, but this is not the case because the surface area is the same per dissipated watt in each of the three coil assemblies, and because the parts of the windings contained inside the cores, where cooling is somewhat impeded, are identical.

Finally, the subject matter described in the above specification and shown in the drawings represents only one version of a transformer according to and defined by the invention. Since many changes may be made in the above construction without departing from the scope of the invention, it is intended that all matter contained in the above description or shown in the accompanying drawings shall be interpreted as illustrative and not limiting.

It is also understood that the following claims are intended to cover all of the generic and specific features of the invention herein described, and all statements of the scope of the invention which, as a matter of language, might be said to fall therebetween.

What is claimed is:

1. Three phase transformer comprising three frame shaped winding assemblies, each containing primary and secondary windings insulated between each other, and forming together half legs of substantially semi-circular cross section, two of said winding assemblies being substantially identical, having their plane surfaces oriented outward, and juxtaposed is such fashion that one half leg of one assembly combines with that of the other assembly into a center leg having substantially circular cross section, the third of said winding assemblies being dimensioned to surround the two said winding assemblies, and having its plane surfaces facing inward, each of its two half legs being juxtaposed with the outside half leg of one of the substantially identical winding assemblies mentioned above, the three winding assemblies forming together, in addition to said center leg, two outside legs having each substantially circular cross section, said winding assemblies being interlinked by hollow, cylindrical cores wound from ferromagnetic strip material, said cores surrounding each of said legs.

2. A three phase transformer according to claim 1, w h e r e i n , in each assembly a low voltage winding is located adjacent to the leg center plane and wound from strip conductor with each turn placed upon and insulated from the previous turn, the sum of the turns forming together a part cross section shaped like a rectangle, and a high voltage winding wound several turns to the layer, the layers being of increasing or diminishing width to form a part cross section shaped substantially like a circle segment, and combining with said low voltage winding into half legs having substantially semi-circular cross section.

3. A three phase transformer according to claim 1 or 2, w h e r e i n the magnetic cores are installed on the legs by rewinding previously wound and heat treated hollow cylindrical cores onto said, substantially circularly sectioned legs.

4. A three phase transformer according to claim 1, w h e r e i n each winding assembly is molded into a rigid frame by means of a suitable, electrically insulating resin.

5. A three phase transformer according to claim 1 or 4, w h e r e i n the plane faces of adjacent winding assemblies are placed sufficiently apart to form passages for cooling fluid along the diametrical planes.

6. A three phase transformer according to claim 1, w h e r e i n the combined winding assemblies are molded into a unified, rigid three legged structure by means of a suitable, electrically insulating resin.

* * * * *